US012529240B2

(12) United States Patent
Stevenson

(10) Patent No.: US 12,529,240 B2
(45) Date of Patent: Jan. 20, 2026

(54) OUTDOOR WEATHER PROTECTION ASSEMBLY

(71) Applicant: iDeaWare Squared, Inc., Merritt Island, FL (US)

(72) Inventor: Tyler A. Stevenson, Teaneck, NJ (US)

(73) Assignee: iDeaWare Squared, Inc., Merritt Island, FL (US)

( * ) Notice: Subject to any disclaimer, the term of this patent is extended or adjusted under 35 U.S.C. 154(b) by 221 days.

(21) Appl. No.: 18/236,308

(22) Filed: Aug. 21, 2023

(65) Prior Publication Data

US 2024/0191538 A1 Jun. 13, 2024

Related U.S. Application Data

(60) Provisional application No. 63/399,659, filed on Aug. 20, 2022.

(51) Int. Cl.
*E04H 15/40* (2006.01)
*E04H 15/00* (2006.01)
*E04H 15/64* (2006.01)

(52) U.S. Cl.
CPC ..... *E04H 15/40* (2013.01); *E04H 15/003* (2013.01); *E04H 15/64* (2013.01)

(58) Field of Classification Search
CPC ..... E04H 15/40; E04H 15/58; E04H 15/003; A45B 2023/0093
See application file for complete search history.

(56) References Cited

U.S. PATENT DOCUMENTS 5,930,854 A * 8/1999 O'Neill ..... A47D 13/063 135/96
6,371,143 B1 * 4/2002 Swetish ..... E04H 15/425 135/125
7,302,724 B2 * 12/2007 Solomon ..... A47D 15/003 5/655
7,926,500 B2 * 4/2011 Perez ..... A47D 13/066 135/125
8,087,423 B2 * 1/2012 Knipschild ..... E04H 15/003 135/117
8,388,501 B2 * 3/2013 Myers ..... A47D 13/00
8,453,664 B2 * 6/2013 Parsons ..... E04H 15/003 135/137
8,602,044 B2 * 12/2013 Zemitis ..... E04H 15/44 135/156

(Continued)

FOREIGN PATENT DOCUMENTS

WO WO-2017175183 A1 * 10/2017

*Primary Examiner* — Noah Chandler Hawk
(74) *Attorney, Agent, or Firm* — Tyler A. Stevenson

(57) ABSTRACT

A weather protection assembly, including three or more support legs, wherein the support legs have an upper end and a lower end, the support legs include a fabric having a top layer, a bottom layer, and a continuous space between the top and bottom layers, the support legs upper ends are configured to meet at an apex and the support legs lower ends are configured to rest on a surface, and the fabric top or bottom layer is coupled to a flexible rod. An independent umbrella may be positioned in the space between fabric layers, which independent umbrella is configured to be freely re-positioned about the assembly. An assembly may include a fixed umbrella portion.

20 Claims, 8 Drawing Sheets

(56) References Cited

U.S. PATENT DOCUMENTS

| | | | | |
|---|---|---|---|---|
| 8,616,932 | B2 * | 12/2013 | Gelfond | E04H 15/48 482/148 |
| 8,882,557 | B2 * | 11/2014 | Fair | B62B 3/1456 5/655 |
| 10,149,530 | B1 * | 12/2018 | Grayson | A45F 4/14 |
| 2007/0079859 | A1 * | 4/2007 | Yang | E04H 15/003 135/137 |
| 2008/0196755 | A1 * | 8/2008 | Cheng | E04H 15/20 135/126 |

* cited by examiner

OUTDOOR WEATHER PROTECTION ASSEMBLY

The disclosure is directed to an assembly for outdoor weather protection, for example for sun protection for use on a beach or for camping.

BACKGROUND

Beach umbrellas may be dangerous in windy conditions. A wind gust is capable of dislodging a beach umbrella from the sand, and a sharp end of a flying umbrella pole may cause injury or even death. Further, beach umbrellas, as well as tarp-like sun shades, have fixed positions. As the sun moves, the shade provided by an umbrella or tarp also moves and a shade area may also be reduced. Often, beach-goers may use a tent to provide sun protection that does not move with the sun, however, tents get hot on a warm day and also block the view of other beach-goers.

Beach umbrellas are also large, heavy, and unwieldy. A beach-goer typically has many things to carry, like beach chairs, boogey boards, a cooler, etc. A heavy umbrella is one more necessary but heavy thing to carry.

Desired is an assembly configured to provide sun protection, wherein the assembly is stable to wind, comprises no dangerous pole having a sharp point, and is adjustable so as to provide shade at various points of the day as the sun moves without having to move oneself. Also desired is a sun protection assembly that is more lightweight, quick and easy to assemble, and more easily stored and carried than a typical beach umbrella. Also desired is a "beach umbrella" assembly having no center pole, thereby providing more space thereunder.

SUMMARY

Accordingly, disclosed is a weather protection assembly, comprising three or more support legs, wherein the support legs have an upper end and a lower end, the support legs comprise a fabric having a top layer, a bottom layer, and a space between the top and bottom layers, the support legs upper ends are configured to meet at an apex and the support legs lower ends are configured to rest on a surface, and the fabric top or bottom layer is coupled to a flexible rod.

The space between the top and bottom layers are configured to receive an independent umbrella portion. The independent umbrella portion is configured to be freely moved and re-positioned about the assembly. As sun, wind, or rain moves, the independent umbrella portion may be moved to optimize protection. In some embodiments, a full tent-like structure may be assembled. A tent fabric may be positioned in the space between fabric layers, and coupled to an assembly floor to provide a full tent-like structure. A tent fabric may be solid or may be a screen.

An assembly may have anchor socks positioned at a lower end of the support legs. Anchor socks may be filled with for example sand, dirt, pebbles, rocks, etc. Filled anchor socks are configured to provide stability to the assembly. An assembly may have a floor. In some embodiments, support legs, a floor, and anchor socks may comprise a same, continuous fabric.

An assembly may have a fixed umbrella portion, which fixed umbrella portion may be symmetrically positioned about an apex of the assembly. An assembly having a fixed umbrella portion may optionally be configured to receive an independent umbrella portion which may be freely moved about the assembly in order to optimize protection from sun, wind, and/or rain.

BRIEF DESCRIPTION OF THE DRAWINGS

This disclosure is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1A:
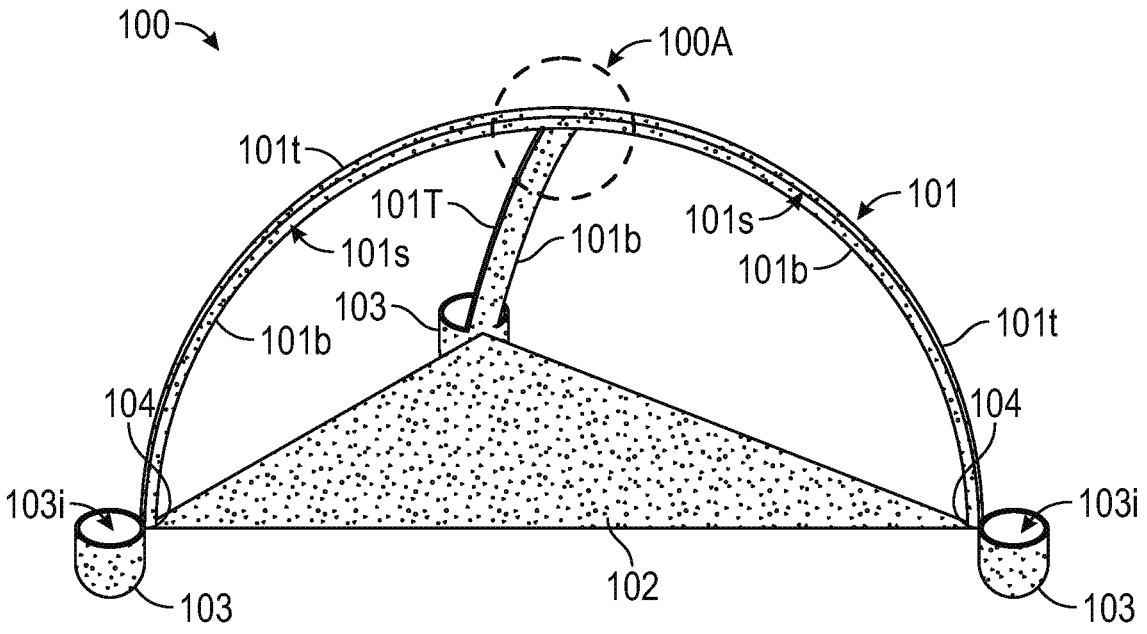
FIG. 1A and FIG. 1B show a weather protection assembly, according to an embodiment.

FIG. 1A shows weather protection assembly 100, according to an embodiment. Assembly 100 comprises support legs 101. Support legs 101 comprises two layers of fabric 101*t* and 101*b*. Anchor socks 103 comprise an open interior 103*i*. Interiors 103*i* of socks 103 may be filled with sand, pebbles, rocks, and the like, and are configured to provide stability to assembly 100 when filled. Assembly 100 comprises floor 102. Fabric of legs 101, floor 102, and socks 103, may be a single, continuous fabric. Layers 101*t*, 101*b*, floor 102, and socks 103 may meet at or near leg lower ends 104; layers 101*t* and 101*b* otherwise are independent and do not meet.

Figure 1B:
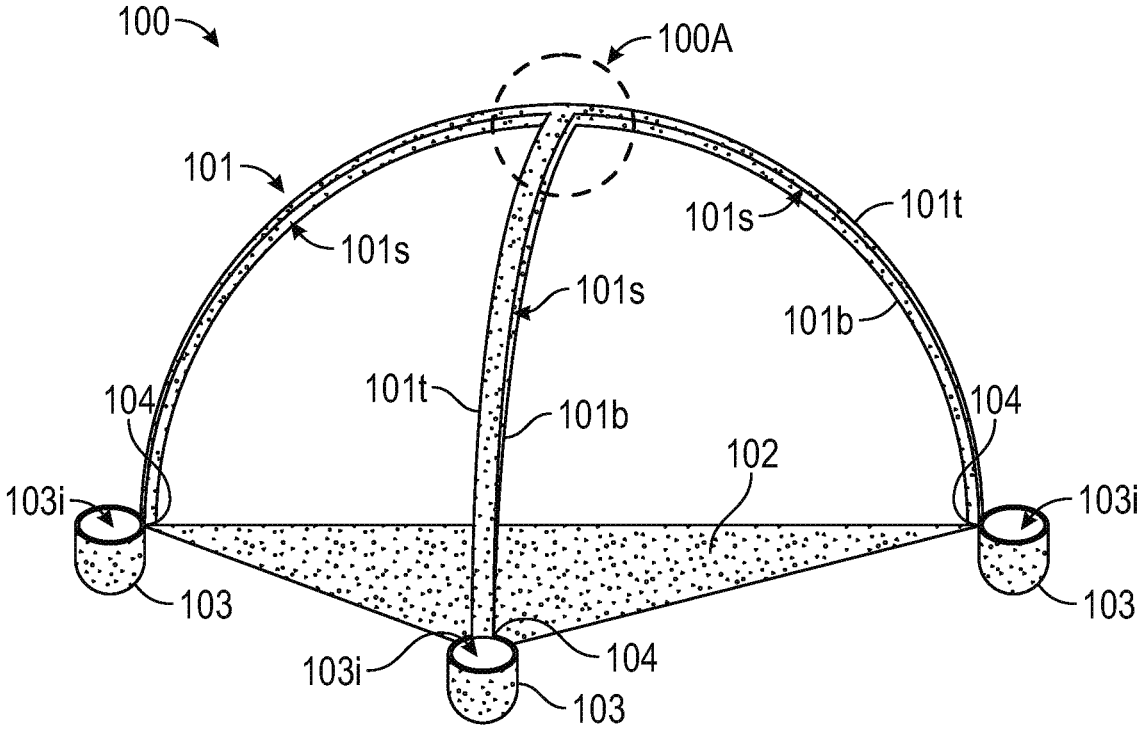

FIG. 1B provides a view of assembly 100 of FIG. 1A rotated about 180°, according to an embodiment. Floor 102 is shown having a triangular shape and meeting legs 101 and socks 103 at leg lower ends 104. A floor having other shapes are possible. An assembly having no floor is also possible. Visible are leg top layer 101*t* and leg bottom layer 101*b*. Layers 101*t* and 101*b* comprise space 101*s* in-between them. Layers 101*t* and 101*b* meet only at or near leg lower ends 104, so that one is able to freely run a finger between them from one point 104 through apex 100A and to another point 104. A volume of assembly 100 including legs 101 and floor 102 may have a partial-sphere shape or a partial-spheroid shape.

Figure 1C:
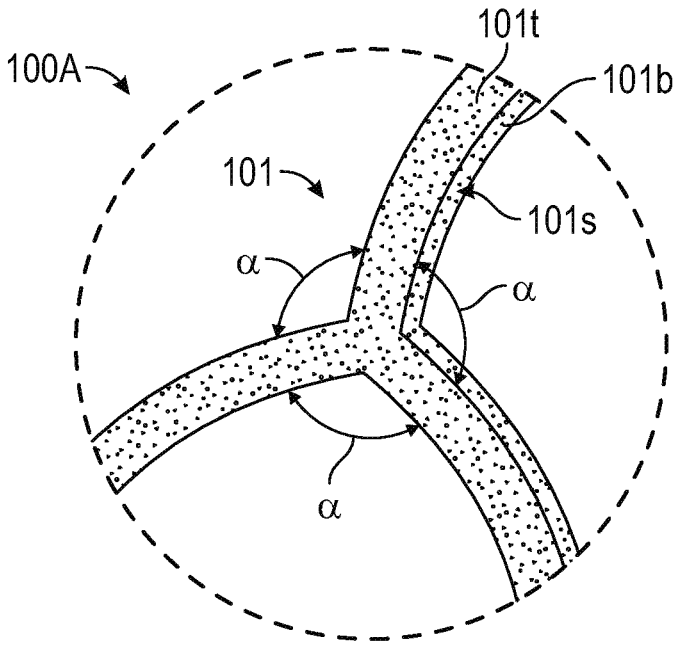
FIG. 1C and FIG. 1D provide close-up views of a portion of a weather protection assembly, according to an embodiment.
Figure 1D:
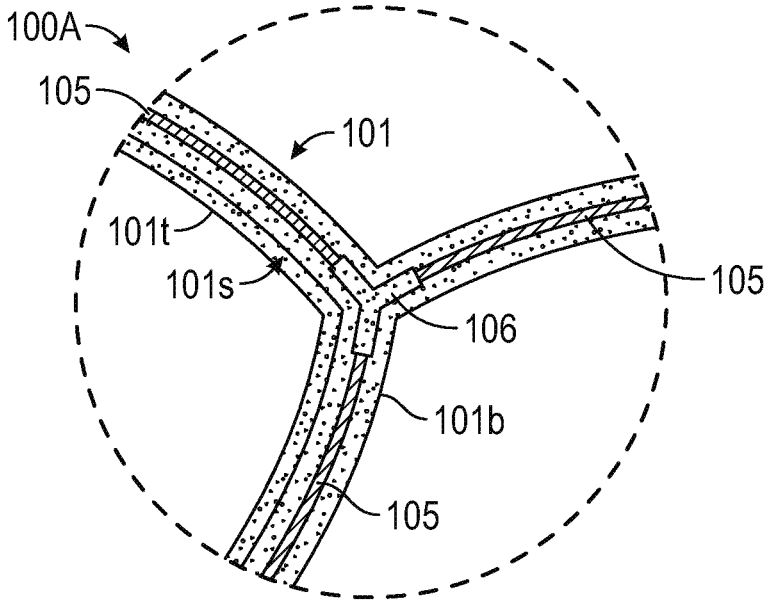

FIG. 1C and FIG. 1D show close-up views of apex 100A, according to some embodiments. FIG. 1C shows a top view of 100A. Visible are leg top layer 101*t* and leg bottom layer 101*b*. Space 101*s* is available between layers 101*t* and 101*b*. Each of three legs 101 have an angle $\alpha$ between them. In this embodiment, each angle $\alpha$ is about 120°. FIG. 1D shows an underneath view of apex 100A. Bottom layer 101*b* is coupled to tent poles 105. Tent poles 105 may be foldable poles having shock cord running through them. Three separate poles 105 are received by coupling feature 106. Coupling feature 106 may comprise a same fabric as that of legs 101. Poles 105 may run from apex 100A to socks 103. In an embodiment, poles exert a force on legs 101 and floor 102 such that layers 101*t* and 101*b* are under tension and are forced together.

Figure 1E:
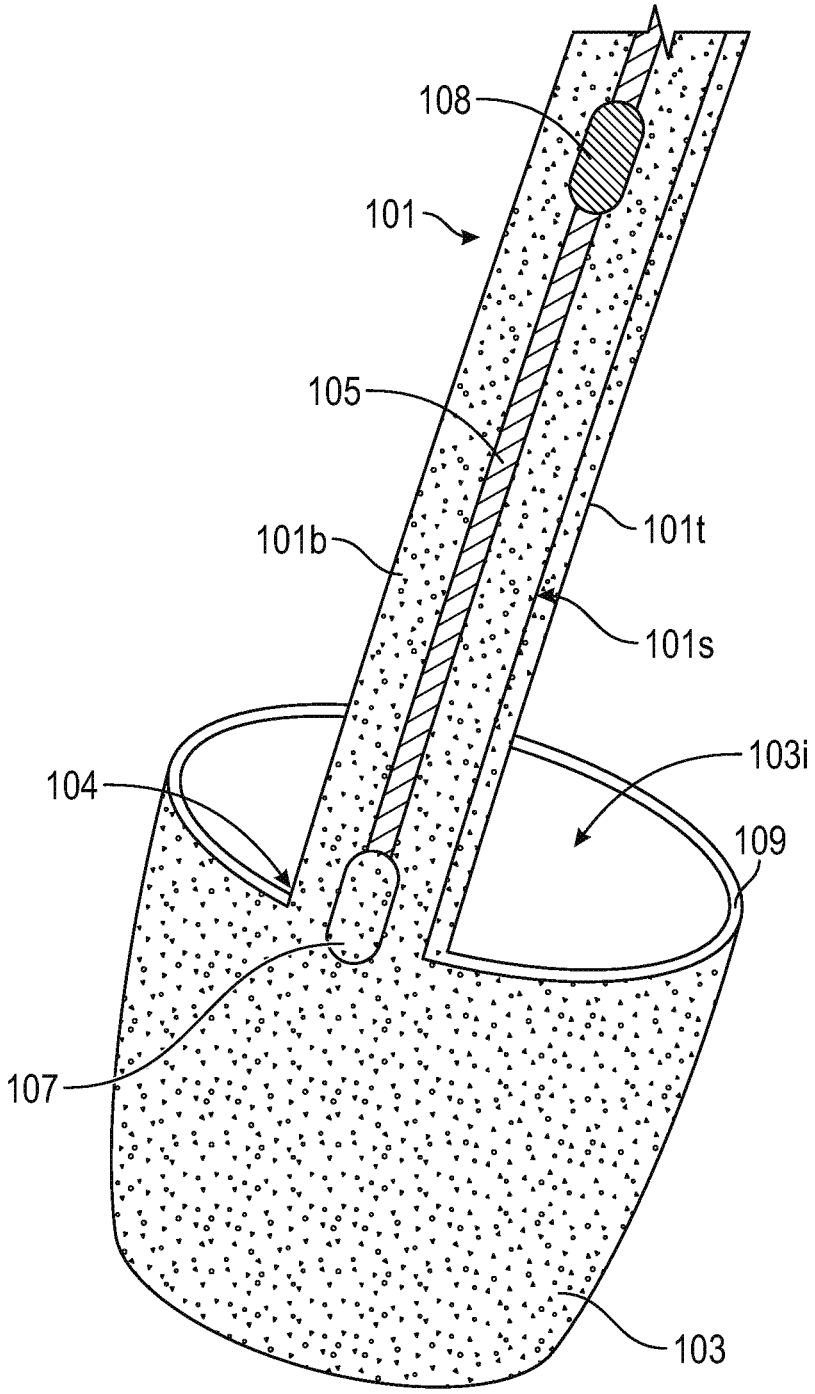
FIG. 1E provides a close-up view of a portion of a weather protection assembly, according to an embodiment.

FIG. 1E shows a close up view of an anchor sock 103. Tent pole 105 runs from apex 100A, through loop 108, and into coupling feature 107. Once sock interior 103*i* is filled with for example sand, it may be configured to sit upright, or it may be configured to sit on its side. In an embodiment, sock rim 109 may comprise a feature, for example a string, configured to enclose sock 103. Coupling feature 107 may be positioned further up or further down leg 101 or sock 103. Layers 101*t* and 101*b* meet at or near point 104.

Figure 1F:
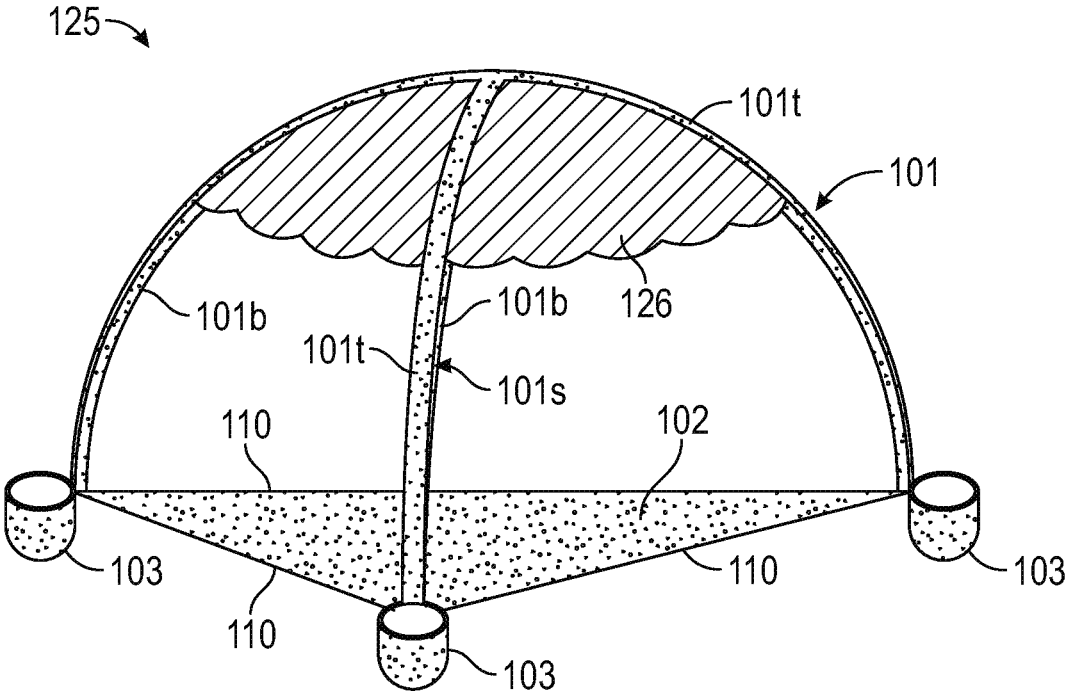
FIG. 1F and FIG. 1G show a weather protection assembly, according to an embodiment.
Figure 1G:
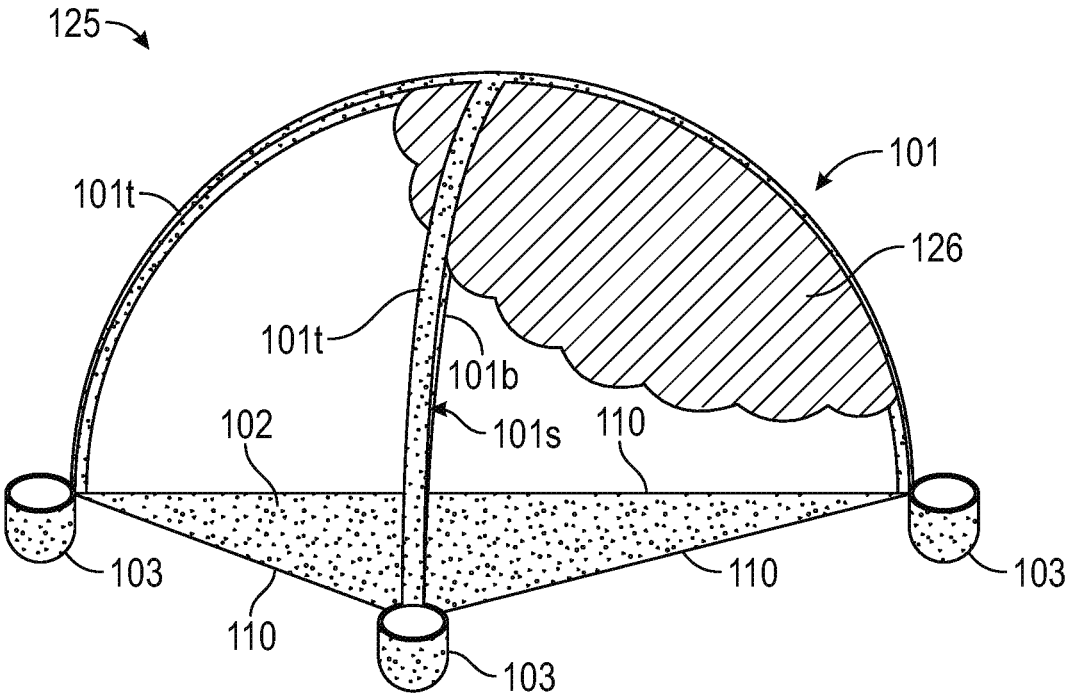

FIG. 1F shows assembly 125, wherein independent umbrella portion 126 has been slipped in continuous space 101*s* of assembly 100. Umbrella 126 is free to be moved about legs 101, and tension provided by tent poles 105 is configured to hold it in place. FIG. 1G shows assembly 125, with umbrella 126 of FIG. 1F having been moved to another position. Umbrella portion 126 may be re-positioned simply by grabbing it and moving to where desired. For example, independent umbrella portion 126 may be moved throughout the day to adjust for movement of the sun. Umbrella 126 may also be moved as desired to provide protection from wind or rain. Floor 102 comprises edges 110. Edges 110 may be fitted with one or more coupling features, for example zippers, snaps, ties, and the like.

Figure 1H:
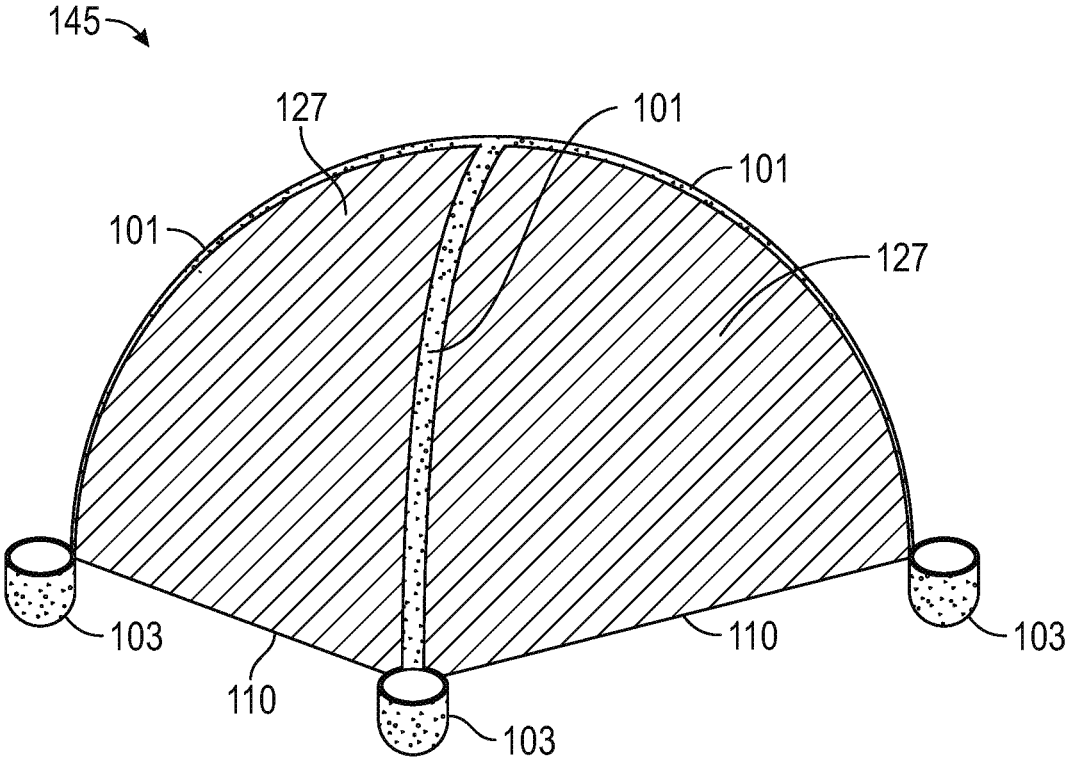
FIG. 1H provides a view of a tent assembly, according to an embodiment.

FIG. 1H shows tent assembly 145. Tent fabric 127 is positioned in space 101*s* of assembly 100, and is fastened to edges 110 via a coupling feature. Suitable coupling features include zippers, snaps, ties, etc. Tent fabric 127 may comprise a solid fabric or, alternatively, may comprise a screen, thereby providing a screened enclosure. Tent fabric may comprise one or more windows or doors comprise zippers or snaps, etc. Anchor feet may be augmented with or replaced with one or more tent spikes.

Figure 2A:
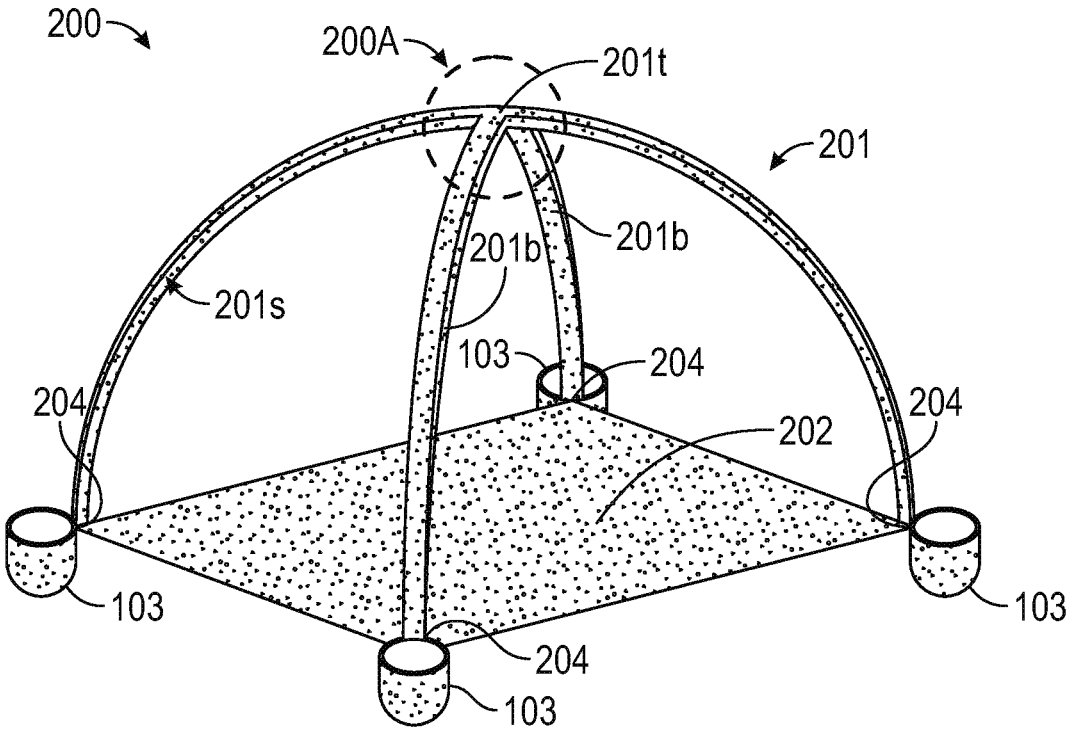
FIG. 2A provides a view of a weather protection assembly, according to an embodiment.
Figure 2B:
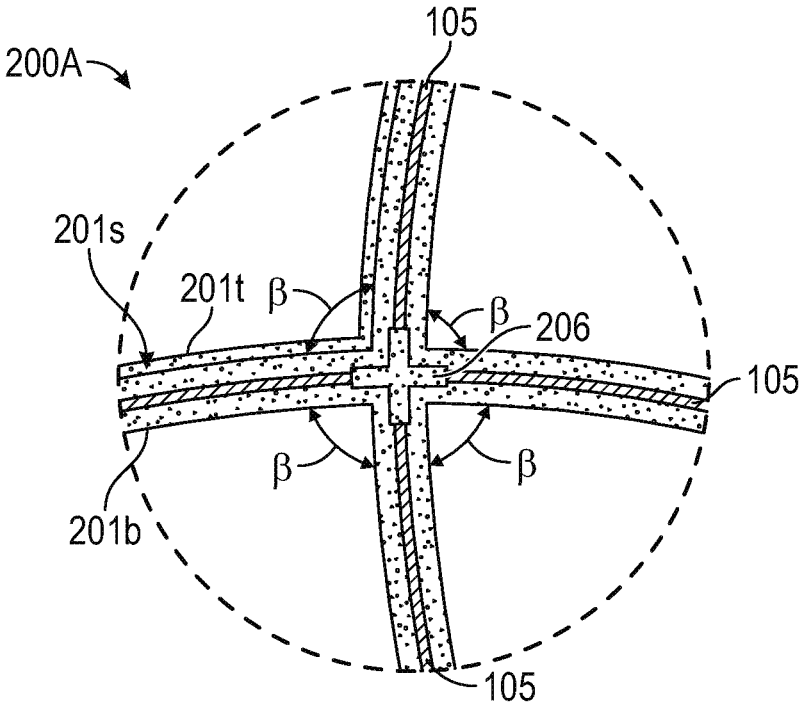
FIG. 2B shows a close-up view of a portion of a weather protection assembly, according to an embodiment.

FIG. 2A shows assembly 200, according to an embodiment. Assembly 200 is similar to assembly 100, but having four legs 201. Shown are leg top layers 201*t*, leg bottom layer 201*b*, space 201*s*, floor 202, and anchor socks 103. Four legs 201 meet at apex 200A. Floor 202 may have a square or a rectangular shape. FIG. 2B provides a close-up, underneath view of apex 200A. Shown are tent poles 105, top layer 201*t*, bottom layer 201*b*, and space 201*s*. Tent poles meet at and are received by coupling feature 206. Coupling feature 206 may comprise a same fabric as that of legs 201. Legs 201 comprise angles β. In this embodiment, angles β are each about 90°. Leg lower ends 204 are coupled to floor 202 and anchor socks 103.

Figure 2C:
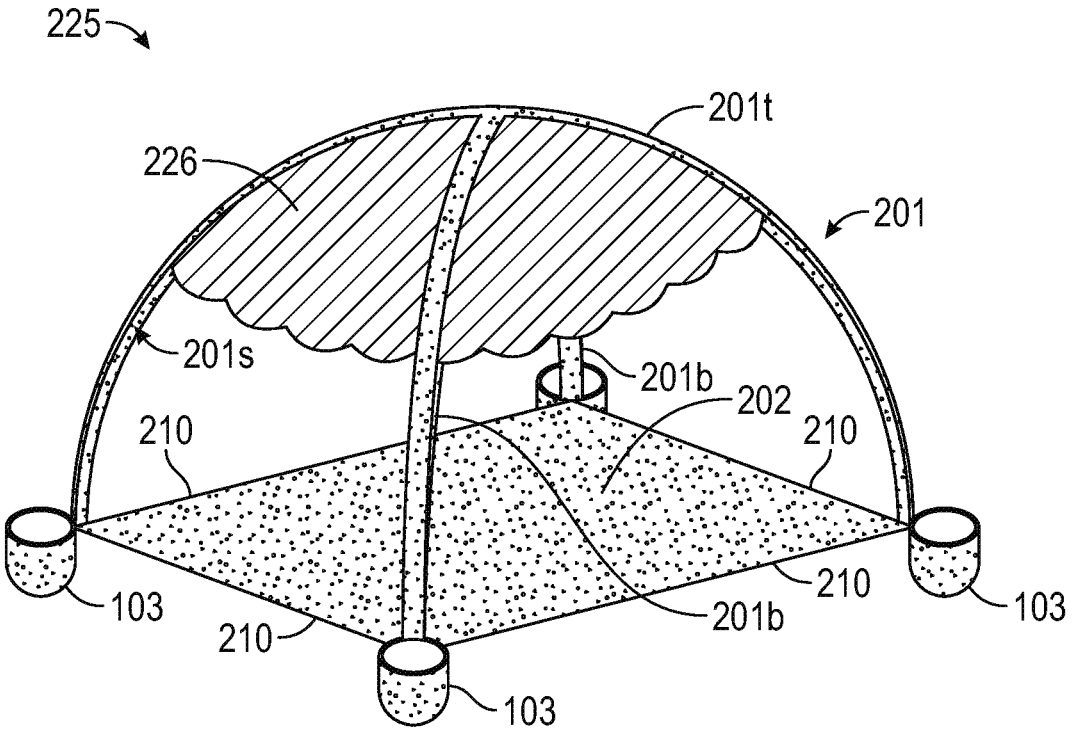
FIG. 2C and FIG. 2D provide views of a weather protection assembly, according to some embodiments.
Figure 2D:
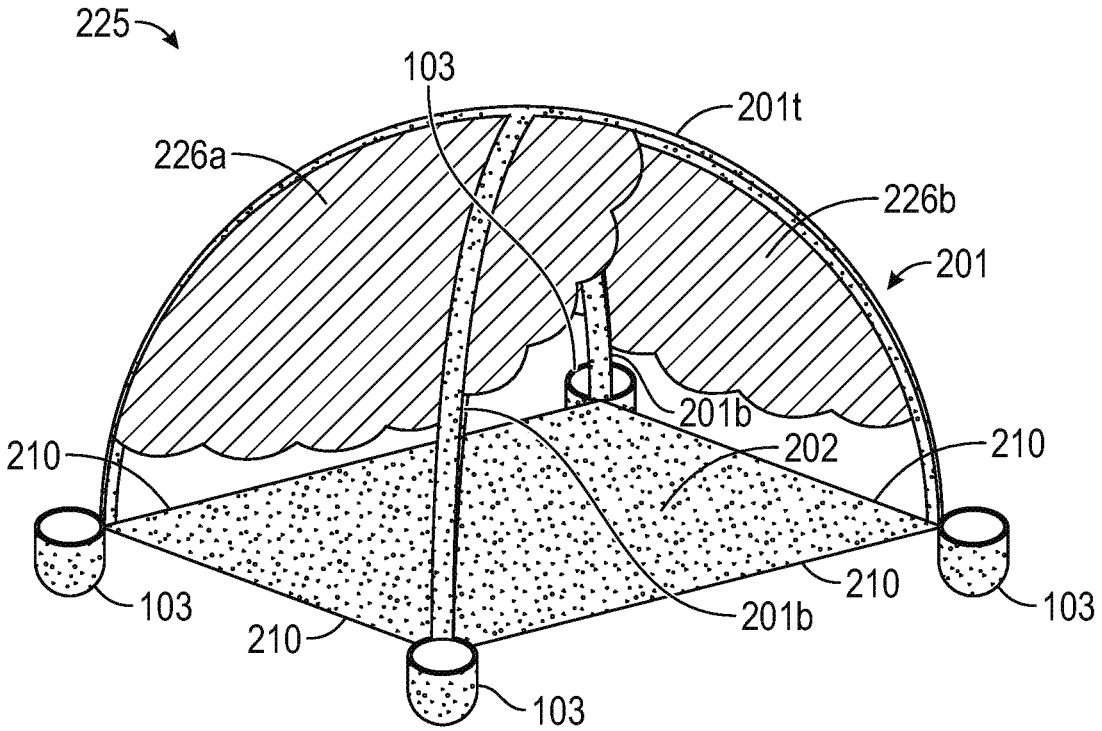

FIG. 2C provides a view of assembly 225, wherein independent umbrella portion 226 has been positioned in space 201*s* of assembly 200. Umbrella portion 226 is free to be re-positioned along legs 201 as desired. FIG. 2D shows assembly 225, wherein two independent umbrellas, 226*a* and 226*b*, have been positioned in space 201*s* of assembly 200. Edges 210 may be fitted with one or more coupling features including zippers, snaps, ties, etc. Assembly 200 may be fitted with a fabric to provide a full tent or full screen structure as shown in FIG. 1H. A full tent or screen fabric may be coupled to edges 210.

Figure 3A:
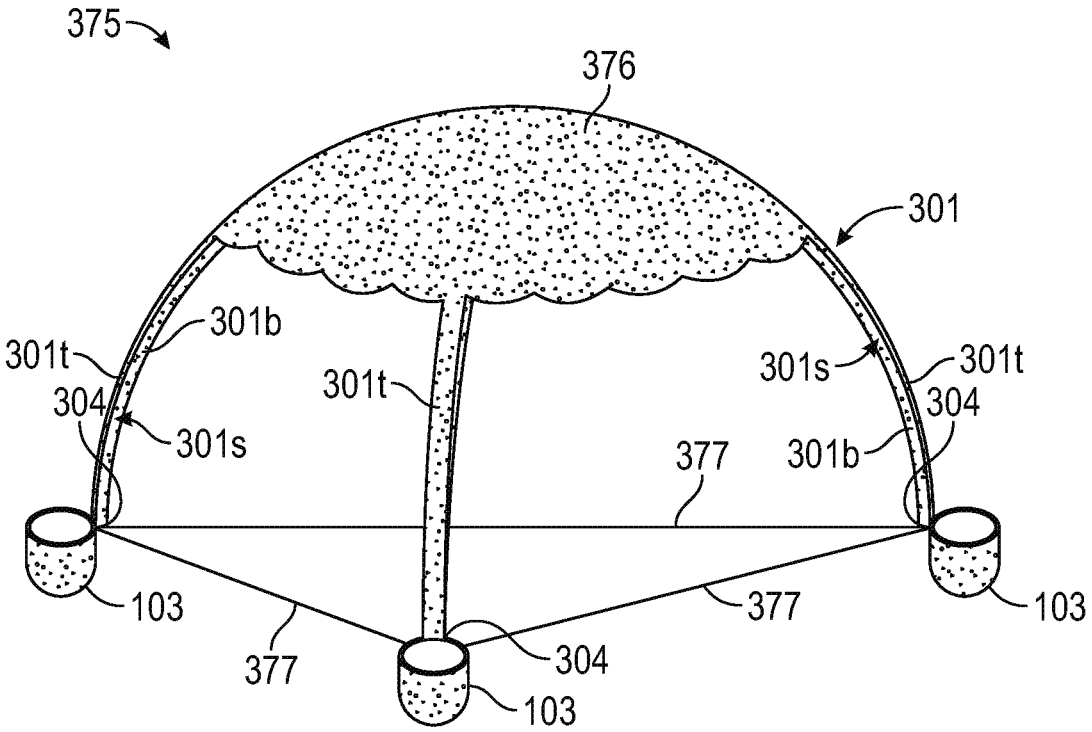
FIG. 3A and FIG. 3B show a weather protection assembly, according to some embodiments.

FIG. 3A shows weather protection assembly 375, according to an embodiment. Assembly 375 is similar to assembly 100, but comprises a fixed umbrella portion 376. Fixed umbrella portion 376 is positioned symmetrically about an apex of assembly 375. Umbrella portion 376 forms a continuous fabric with support leg top layers 301*t*. In another embodiment, a fixed umbrella portion may form a continuous fabric with a support leg bottom layer, or with both top and bottom layers. Space 301*s* runs an entire length from one support leg 301, through an apex at a top point of fixed umbrella portion 376, and to another leg 301, such that one may position a second independent umbrella portion therein and move it about the entire assembly.

Figure 3B:
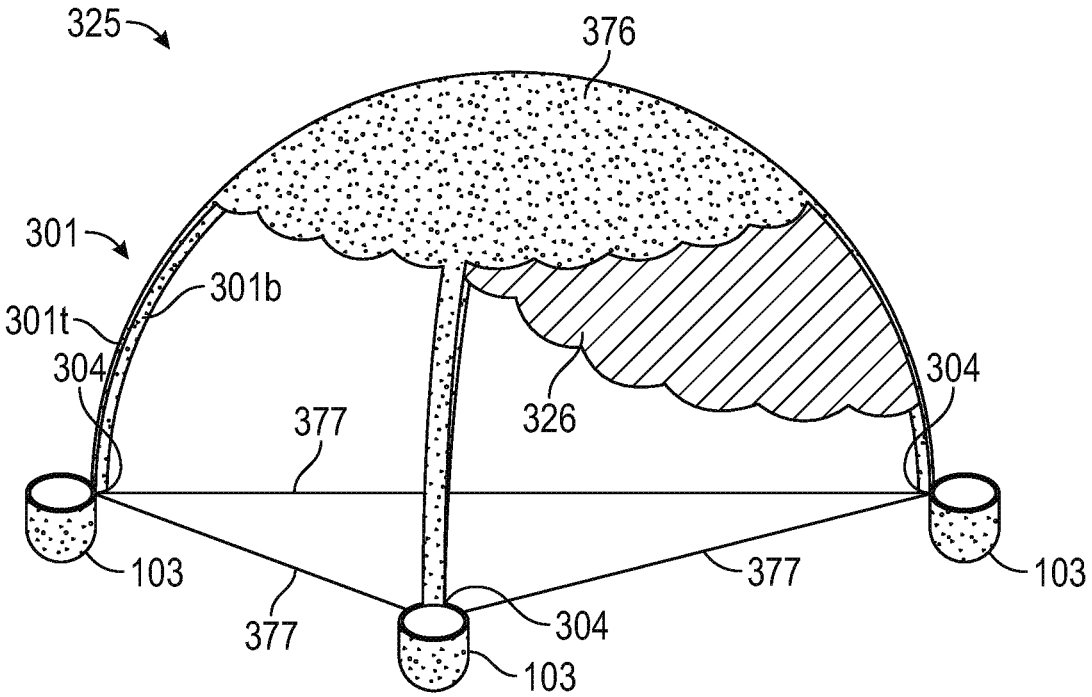

FIG. 3B shows assembly 325, wherein a second, independent umbrella portion 326 has been positioned in space 301*s* of assembly 375. Umbrella portion 326 may be freely moved and repositioned about assembly 325 in order to provide extra and/or optimal sun, wind, or rain protection already afforded by fixed umbrella portion 376. Alternatively to having a floor, assemblies 375 and 325 comprise fabric strips 377 connected to legs 301 at points 304.

The figures show a double-layer fabric having flexible rods coupled to an underside of a bottom layer. In other embodiments, a double-layer fabric having a continuous space in-between may have flexible rods coupled to a "top side" of an upper layer.

In some embodiments, support leg fabric top layer and bottom layer may comprise a first fabric, and an umbrella portion may comprise a second fabric. A first and second fabric may be the same or different. A first or second fabric may be natural, synthetic, or a blend, and may comprise for example nylon, cotton, polyester, acrylic, or blends thereof. In some embodiments, an umbrella second fabric may have a greater thickness than a first fabric. In some embodiments, a first and/or second fabric may have applied thereto or infused therein an ultraviolet (UV) absorber compound. In some embodiments, a first and/or second fabric may have applied thereto or infused therein a hindered amine light stabilizer (HALS) compound.

In some embodiments, a volume of a present assembly may comprise a partial-sphere or partial spheroid shape. In some embodiments, an umbrella fabric of the present assembly may be freely moved and re-positioned about the partial-sphere or partial spheroid shape, thereby providing optimal protection from sun, wind, or rain.

Flexible tent poles are known, and may be foldable tent poles having a hollow center and connected with shock cord. Such tent poles may comprise for instance aluminum or fiberglass.

Advantageously, a present assembly comprising an umbrella portion will have no traditional tent pole, that is, no center pole supporting the umbrella. An umbrella of the present disclosure may be supported simply with the support legs. The flexible tent poles are configured to provide a tension to the assembly, so that an umbrella fabric may be held in a desired position in the space between a support leg top layer and bottom layer.

A present umbrella portion may comprise no traditional folding rib structure. A present umbrella portion may comprise a single fabric structure. In some embodiments, an umbrella may comprise a rib structure configured to assist in holding it in place and to provide structure. A rib structure may be inside the umbrella fabric, or on a top and/or bottom thereof. An umbrella fabric, or umbrella portion may have a circular or oval shape. In other embodiments, an umbrella portion may have a non-traditional shape, for instance a square, rectangular, or other shape. In some embodiments, a present assembly may employ more than one umbrella portion, for example 2, 3, 4, or more umbrella portions.

In some embodiments, a first umbrella portion may be fixed in position and be a fixed part of a top and/or bottom support leg fabric layer. In this embodiment, as assembly may comprise one or more further umbrella portions that are free to be moved about the assembly. In some embodiments, an umbrella portion may comprise one or more vents.

In some embodiments, a present assembly may comprise 3, 4, 5, 6, or more support legs. A present assembly may be sized to accommodate 2, 3, 4, 5, 6, 8, or more people underneath an umbrella portion, either in a seated or standing position. In some embodiments, an assembly may comprise a single flexible rod associated with each support leg and configured to couple to a support leg bottom layer. In other embodiments, a flexible rod may run an entire length from one support leg lower end, through an apex, and to another support leg lower end. For example, a 4-legged apparatus may comprise 4 separate flexible rods as shown in FIG. 2B. Alternatively, a 4 legged apparatus may comprise 2 flexible rods, wherein each rod runs from one support leg lower end, through the apex, and to an opposing support leg lower end. The 2 flexible rods will run past each other in the apex. A flexible rod may run along a top of a fabric bottom layer, or may run along a bottom of a fabric bottom layer.

In some embodiments, an assembly may comprise a floor, which may be configured to help keep a desired shape of the assembly. A floor may comprise a triangular, square, rectangular, circle, oval, or other shape.

In some embodiments, a support leg fabric, floor, and/or anchor socks may comprise a single, continuous fabric. A support leg top layer and bottom layer may meet only at or near a leg lower end, for example at or near a floor and/or anchor sock. A support leg top layer and bottom layer fabric may comprise a minimal width, for example from about 0.5 inches, about 0.7 inches, about 1.0 inches, or about 1.2 inches, to any of about 1.5 inches, about 1.7 inches, about 2.0 inches, or more. In some embodiments, a support leg top layer fabric may have a same width as a bottom layer fabric. In other embodiments, a support leg top layer fabric may have a different width than a bottom layer fabric. For example, a bottom layer fabric may be wider than a top layer fabric. This may help one locate a space between the top layer and bottom layer. In some embodiments, a support leg top and/or bottom fabric layer may instead comprise a rope or cord rather than a fabric layer. A term "continuous fabric" may mean a single fabric, which may contain sewed joints. In other embodiments, an anchor sock may be removably coupled to an assembly, for example with a cord or a snap fit coupling.

In some embodiments, angles between support legs at an apex may be about the same, as shown in FIG. 1C and FIG. 2B. Alternatively, angles may be non-equivalent. For instance, in a three-legged apparatus, an angle between a first and a second leg may be as much as about 180°. An angle between a second and third leg and between a third and first leg may each be about 90°. Such an assembly may provide for optimal visibility from the assembly. In some embodiments, each support leg, and each flexible rod may have a same length. In other embodiments, support legs may have different lengths. For example, in a three-legged apparatus, a first and second leg may have a same length, and a third leg may have a longer or shorter length.

In some embodiments, anchor socks may be a permanent part of fabric comprising support leg top and bottom layers. In some embodiments, a floor may be a permanent part of fabric comprising support leg top and bottom layers. In other embodiments, anchor socks may be detachable and may be coupled to a support leg lower end with a coupling feature such as a snap, clip, tie, etc. In some embodiments, a floor may be detachable and may likewise be coupled to support leg lower ends with one or more coupling features.

In some embodiments, a present assembly may comprise only two components, a fabric comprising support legs and an umbrella portion, and flexible rods. In some embodiments, an assembly may comprise three components, a fabric comprising support legs, a separate independent umbrella portion, and flexible rods.

Following are some embodiments of the disclosure.

In a first embodiment, disclosed is a weather protection assembly, comprising three or more support legs, wherein the support legs have an upper end and a lower end, the support legs comprise a fabric having a top layer, a bottom layer, and a continuous space between the top and bottom layers, the support legs upper ends are configured to meet at an apex and the support legs lower ends are configured to rest on a surface, and the fabric top layer or bottom layer is configured to couple to a flexible rod.

In a second embodiment, disclosed is a weather protection assembly according to the first embodiment, wherein the flexible rod comprises a foldable tent/pole shock cord assembly. In a third embodiment, disclosed is a weather protection assembly according to embodiments 1 or 2, wherein the flexible rod comprises an upper end coupled to the fabric top layer or bottom layer at or near the apex.

In a fourth embodiment, disclosed is a weather protection assembly according to any of the preceding embodiments, wherein the flexible rod comprises a lower end coupled to the fabric bottom layer at or near the support leg lower end. In a fifth embodiment, disclosed is a weather protection assembly according to any of the preceding embodiments, wherein each support leg lower end is coupled to a floor or to a fabric strip. In a sixth embodiment, disclosed is a weather protection assembly according to embodiment 5, wherein the floor comprises a triangular, square, rectangular, circle, or oval shape. In a seventh embodiment, disclosed is a weather protection assembly according to embodiments 5 or 6, wherein the support leg top layer, bottom layer, and the floor comprise a continuous fabric. In an eighth embodiment, disclosed is a weather protection assembly according to any of embodiments 5 to 7, wherein the floor comprises an edge, and wherein the edge comprises a coupling feature.

In a ninth embodiment, disclosed is a weather protection assembly according to any of the preceding embodiments, wherein two or more support legs lower ends are coupled to an anchor sock, the anchor socks are configured to receive a be filled with a solid, and the solid-filled anchor socks are configured to provide stability to the weather protection assembly.

In a tenth embodiment, disclosed is a weather protection assembly according to embodiment 9, wherein the support legs and the anchor socks comprise a continuous fabric. In an eleventh embodiment, disclosed is a weather protection assembly according to any of the preceding embodiments, comprising 3, 4, 5, or 6 support legs.

In a twelfth embodiment, disclosed is a weather protection assembly according to any of the preceding embodiments, comprising an independent umbrella portion positioned in the space between the support leg top and bottom layers. In a thirteenth embodiment, disclosed is a weather protection assembly according to embodiment 12, wherein the independent umbrella portion is configured to re-positioned by moving it within the space between the support leg top and bottom layers.

In a fourteenth embodiment, disclosed is a weather protection assembly according to embodiments 12 or 13, wherein the flexible rods are configured to provide a tension such that the independent umbrella portion is held in a desired position. In a fifteenth embodiment, disclosed is a weather protection assembly according to any of embodiments 12 to 14, comprising no center pole. In a sixteenth embodiment, disclosed is a weather protection assembly according to any of embodiments 12 to 15, wherein the independent umbrella portion comprises no foldable ribs.

In a seventeenth embodiment, disclosed is a weather protection assembly according to any of embodiments 12 to 16, wherein the independent umbrella portion comprises support ribs. In an eighteenth embodiment, disclosed is a weather protection assembly according to any of embodiments 12 to 17, wherein the support legs comprise a first fabric, and the independent umbrella portion comprises a second fabric. In a nineteenth embodiment, disclosed is a weather protection assembly according to embodiment 18, wherein the second fabric is thicker than the first fabric. In a twentieth embodiment, disclosed is a weather protection assembly according to any of embodiments 12 to 19, comprising two or more independent umbrella portions.

In a twenty-first embodiment, disclosed is a weather protection assembly according to any of the preceding embodiments, comprising a fixed umbrella portion, wherein the fixed umbrella portion is positioned about the apex and is continuous with the support leg fabric top layer, bottom layer, or both the support leg top and bottom layers. In a twenty-second embodiment, disclosed is a weather protection assembly according to embodiment 21, comprising an independent umbrella portion positioned in the space between the support leg top and bottom layers, wherein the independent umbrella portion is configured to re-positioned about the assembly by moving it within the space.

In a twenty-third embodiment, disclosed is a weather protection assembly according to any of the preceding embodiments, comprising a fabric positioned in the space between the support leg top and bottom layers, and coupled to the floor edge. In a twenty-fourth embodiment, disclosed is a weather protection assembly according to embodiment 23, wherein the tent fabric coupled to the floor edge provides a continuous tent structure. In a twenty-fifth embodiment, disclosed is a weather protection assembly according to embodiment 24, wherein the fabric comprises a screen.

The terms "coupled" or "connected" may mean that an element is "attached to" or "associated with" another element. Coupled or connected may mean directly coupled or coupled through one or more other elements. An element may be coupled to an element through two or more other elements in a sequential manner or a non-sequential manner. The term "via" in reference to "via an element" may mean "through" or "by" an element. Coupled or connected or "associated with" may also mean elements not directly or indirectly attached, but that they "go together" in that one may function together with the other.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, or ±10%. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, or ±10% of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A weather protection assembly, comprising three or more support legs, wherein the support legs have an upper end and a lower end, the support legs comprise a fabric having a top layer, a bottom layer, and a continuous space between the top and bottom layers, the support legs upper ends are configured to meet at an apex and the support legs lower ends are configured to rest on a surface, and the fabric top layer or bottom layer is coupled to a flexible rod, and wherein the weather protection assembly comprises an independent umbrella portion configured to be positioned in the space between the support leg top and bottom layers, and the independent umbrella portion is configured to be re-positioned by moving it within the space between the support leg top and bottom layers.

2. The weather protection assembly according to claim 1, wherein the flexible rod comprises a foldable tent/pole shock cord assembly, the flexible rod comprises an upper end coupled to the fabric top layer or bottom layer at or near the apex, and the flexible rod comprises a lower end coupled to the fabric bottom layer at or near the support leg lower end.

3. The weather protection assembly according to claim 1, wherein each support leg lower end is coupled to a floor or to a fabric strip.

4. The weather protection assembly according to claim 3, comprising a floor having a triangular, square, rectangular, circle, or oval shape.

5. The weather protection assembly according to claim 3, wherein the support leg top layer, bottom layer, and the floor or strip comprise a continuous fabric.

6. The weather protection assembly according to claim 1, wherein two or more support legs lower ends are coupled to an anchor sock, the anchor socks are configured to receive a be filled with a solid, and the solid-filled anchor socks are configured to provide stability to the weather protection assembly.

7. The weather protection assembly according to claim 1, comprising 3, 4, 5, or 6 support legs.

8. The weather protection assembly according to claim 1, comprising a partial sphere or a partial spheroid shape.

9. The weather protection assembly according to claim 1, wherein the fabric comprises nylon, cotton, polyester, acrylic, or a blend thereof.

10. The weather protection assembly according to claim 1, wherein the flexible rods are configured to provide a tension such that the independent umbrella portion is held in a desired position.

11. The weather protection assembly according to claim 1, comprising no center pole.

12. The weather protection assembly according to claim 1, wherein the independent umbrella portion comprises no foldable ribs.

13. The weather protection assembly according to claim 1, wherein the independent umbrella portion comprises support ribs.

14. The weather protection assembly according to claim 1, wherein the support legs comprise a first fabric, and the independent umbrella portion comprises a second fabric.

15. The weather protection assembly according to claim 14, wherein the second fabric is thicker than the first fabric.

16. The weather protection assembly according to claim 1, comprising two or more independent umbrella portions.

17. The weather protection assembly according to claim 1, comprising a fixed umbrella portion, wherein the fixed umbrella portion is positioned about the apex and is continuous with the support leg fabric top layer, bottom layer, or both the support leg top and bottom layers.

18. The weather protection assembly according to claim 17, comprising an independent umbrella portion positioned in the space between the support leg top and bottom layers, wherein the independent umbrella portion is configured to be re-positioned about the assembly by moving it within the space.

19. The weather protection assembly according to claim 1, comprising a fabric positioned in the space between the support leg top and bottom layers, and coupled to the floor edge.

20. The weather protection assembly according to claim 19, wherein the fabric coupled to the floor edge provides a continuous tent structure.

* * * * *